US007029377B2

(12) United States Patent
Bauer et al.

(10) Patent No.: US 7,029,377 B2
(45) Date of Patent: Apr. 18, 2006

(54) BUFFING HEAD AND METHOD FOR RECONDITIONING AN OPTICAL DISC

(75) Inventors: Jason Bauer, Creek, AZ (US); Alexander Shekhel, Chandler, AZ (US)

(73) Assignee: Azuradisc, Inc., Chandler, AZ (US)

( * ) Notice: Subject to any disclaimer, the term of this patent is extended or adjusted under 35 U.S.C. 154(b) by 0 days.

(21) Appl. No.: 11/251,182

(22) Filed: Oct. 11, 2005

(65) Prior Publication Data

US 2006/0030246 A1 Feb. 9, 2006

Related U.S. Application Data

(62) Division of application No. 10/712,188, filed on Nov. 12, 2003, now Pat. No. 6,966,823.

(51) Int. Cl.
*B24B 1/00* (2006.01)
*B24B 7/04* (2006.01)

(52) U.S. Cl. ..... 451/41; 451/65; 451/209; 451/211

(58) Field of Classification Search ..... 451/41, 451/54, 56, 57, 65–67, 72, 104, 106, 109, 451/113, 178, 209, 211, 344, 358, 461, 489; 15/97.1, 102, 230, 265.5, 366, DIG. 14
See application file for complete search history.

(56) References Cited

U.S. PATENT DOCUMENTS 3,943,666 A 3/1976 Dian et al.
4,179,852 A 12/1979 Barnett
4,257,616 A * 3/1981 Pless ..... 15/230
4,347,689 A 9/1982 Hammond
4,556,433 A 12/1985 Clausen
4,783,870 A 11/1988 Yeung
5,099,618 A 3/1992 Schmid
5,102,099 A 4/1992 Brown et al.
5,369,916 A 12/1994 Jefferies et al.
5,423,103 A 6/1995 Born
5,593,343 A 1/1997 Bauer
5,954,566 A 9/1999 Bauer
6,199,238 B1 3/2001 Huang
6,261,159 B1 7/2001 Krieg et al.
6,322,430 B1 11/2001 Kennedy et al.
6,595,835 B1 7/2003 Gadbois

OTHER PUBLICATIONS

Specialty Store Services, New Edge Disc Repair SKU#7942, www.specialtystoreservices.com/store/index.asp?method=pd&p_ID=1901, Oct. 6, 2003.

(Continued)

*Primary Examiner*—David B. Thomas
(74) *Attorney, Agent, or Firm*—Meschkow & Gresham, PLC

(57) ABSTRACT

A buffing head (34) includes a rotary element (36) for retaining an optical disc (20) and causing the disc (20) to rotate at a first speed. A buffing element (38) contacts a work surface (30) of the optical disc (20), and rotation of the disc (20) enables corresponding movement of the buffing element (38). A restrictor (40), in communication with the buffing element (38), restricts movement of the buffing element (38) so that the buffing element (38) moves at a second speed to recondition the work surface (30), the second speed being slower than the first speed. The buffing head (34) further includes a well (86) surrounding the buffing element (38) and containing a fluid (88). Movement of the buffing element (38) causes the buffing element (38) to be immersed into the fluid (88) and to be returned into contact with the work surface (30).

15 Claims, 6 Drawing Sheets

OTHER PUBLICATIONS

Totaldiscrepair.com, Discus/revolution in CD repair technology, www.totaldiscrepair.com/prod01.php, Oct. 6, 2003.
Suoya Science & Technology Industrial Co., Ltd., SY-4 CD Repair Machine, www.suoya.com/english/auto.htm, Oct. 6, 2003.
Disc-Go-Mech, "Disc-Go-Mech" CD Repair Machine, www.vcdr.com/disgomech.htm, Oct. 6, 2003.
Compact Disc Repairman, Inc., Prospective customers information and Order Sheet, www.cdrepairman.com.
CD/DVD/Game Repair Machine, Tomato Land Display Systems, Inc., www.tomatolandisplays.com/media/pages/cdrepair.html, Oct. 6, 2003.
SMZ57 Two Head polishing Machine, www.buffingandpolishing.com/smz_57.htm, Oct. 7, 2003.

* cited by examiner

BUFFING HEAD AND METHOD FOR RECONDITIONING AN OPTICAL DISC

RELATED PATENT

The present patent is a divisional of "Buffing Head and Method for Reconditioning an Optical Disc", Ser. No. 10/712,188, filed on 12 Nov. 2003, now U.S. Pat. No. 6,966,823.

TECHNICAL FIELD OF THE INVENTION

The present invention relates generally to optically-read digital recording discs. More specifically, the present invention relates to reconditioning the protective surface of optically-read digital recording discs.

BACKGROUND OF THE INVENTION

Optical-read digital recording discs, including compact discs (CDs), digital versatile discs (DVDs), CD-ROMs, recordable CDs (CD-Rs), re-writable CDs (CD-RWs), game discs, and the like, are widely used to store different types of information. Such optical discs may be formatted for use with audio, video, game, or computer equipment that reads the data recorded on the discs. The technology associated with optical discs and digital playback equipment is well known to those skilled in the art. Basically, digital information is encoded and arranged in spiral data tracks within the disc beneath an optically transparent protective layer, or surface, of plastic. A laser beam reads the digital information during playback, and the information is then processed and presented to the user in the form of sound, visual images, or computer data.

The optically transparent protective surface forms the bulk of the thickness and weight of the disc. Generally, the protective surface protects the data layer from damage on the play side. In addition, the protective surface acts as a transparent substrate to support the data layer of the disc. Damage or surface imperfections located on the transparent protective surface can interfere with the laser beam before it reaches the data layer. Although modern playback devices include error correction techniques, this interference can prevent the player from reading the data correctly, or at all, even though the data layer itself is undamaged.

In recent years, the disc reclamation industry has prospered due to the widespread use and longevity of digital recording discs. However, many used discs cannot be resold because imperfections in the protective surface render them unplayable or visually unappealing. Consequently, to improve disc playability and visual appeal for resale, various methods for reconditioning the protective surface of an optical disc have been developed. The desire to improve disc playability and visual appeal is not limited to the reclamation industry. Many individuals desire to have the capability to recondition their discs at home.

A reconditioning apparatus that has substantial disc throughput, while effectively reconditioning optical discs, is fundamental to economic success in the commercial/industrial market. However, throughput may be less of a concern in the consumer market since the quantity of discs to be reconditioned by a consumer is likely to be much lower than that for the commercial market. As such, a reconditioning apparatus that is both affordable and effective at reconditioning optical discs is crucial to success in the consumer market.

It should be noted that in a reconditioning device, buffing speed should be balanced with heat removal. That is, the faster the relative speed between the buffing element and the optical disc, the faster the reconditioning. However, if the relative speed is inadequately controlled, i.e., the relative speed is too great, cooling liquid and polishing compound can be simply flung off of the optical disc. This leads to waste of the cooling liquid and/or polishing compound, as well as ineffective heat absorption and buffing.

Some machines use multiple motors or complicated transmission systems to drive both the buffing element and the optical disc in order to control the speed of the buffing element and the optical disc. Such devices are undesirably costly and have a higher probability of component failure due to the complexity of the equipment.

The pressure between the buffing element and the optical disc also affects the effectiveness of the reconditioning process. If the pressure is too great, too much material may be removed, which can damage the underlying data track and/or cause excessive heat build up. Conversely, if the pressure is too low, reconditioning time becomes undesirably long and less cost effective, especially in the commercial market. Yet another problem associated with pressure is the effect of uneven pressure between the contact surface of the buffing element and the protective surface of the optical disc. This uneven pressure can result in non-uniform reconditioning of the protective surface. This non-uniform reconditioning may cause laser beam focus problems, vibrations, and signal distortion during playback.

In order to control the pressure between the buffing element and the protective surface of the optical disc, many reconditioning devices employ complex and costly mechanisms that provide motion in multiple planes. By way of example, buffing elements may be rotated into position in one plane, then raised or lowered into position against the optical disc. Yet others use a flat, planar buffing surface that must be precisely aligned with the planar optical disc. Again, such devices are undesirably costly and have a higher probability of component failure due the complexity of the equipment.

It is known that optical discs can be effectively reconditioned by employing several sequential, successively finer, buffing stages. Conventional reconditioning devices require replacement of the buffing elements to progress from coarse to finer buffing stages, and/or complex machinery to return (i.e., raise or lower) the buffing elements into position against the optical disc between each of the buffing stages. Unfortunately, while this method may effectively repair the protective coating of a single digital disc, it is so time consuming that it is impractical for repairing a large number of discs. Furthermore, the complex machinery is too costly for the consumer market. Moreover, debris from the coarse buffing stage can contaminate the protective surface of the optical disc when performing the fine buffing, thus compromising the effectiveness of the finer buffing stages.

Accordingly, what is needed is a buffing head for a reconditioning apparatus that effectively and time-efficiently reconditions optical discs. There is also a need for a basic buffing element that is expandable between consumer, commercial, and industrial reconditioning apparatuses. That is, a buffing head, utilizing the buffing element, should be configurable for use in an affordable reconditioning apparatus for consumer applications. In addition, a buffing head, utilizing the buffing element should be configurable for high throughput reconditioning apparatuses for commercial/industrial applications.

SUMMARY OF THE INVENTION

Accordingly, it is an advantage of the present invention that a buffing head and a method are provided that restore both the playback quality and the visual appearance of an optical disc.

It is another advantage of the present invention that a buffing head and method are provided that adequately control buffing parameters to yield effective scratch removal from the protective surface of the disc.

Another advantage of the present invention is that a buffing head and method are provided that facilitate the use, and mitigates the waste, of cooling liquid.

Yet another advantage of the present invention is that the buffing head is readily expandable between consumer and commercial/industrial applications.

The above and other advantages of the present invention are carried out in one form by a buffing head for reconditioning a work surface of an optical disc. The buffing head includes a rotary element for rotating the disc at a first speed, and a buffing element configured to contact the work surface so that rotation of the disc enables corresponding movement of the buffing element. A restrictor is in communication with the buffing element for restricting movement of the buffing element such that the buffing element moves at a second speed to recondition the work surface, the second speed being slower than the first speed.

The above and other advantages of the present invention are carried out in another form by a buffing head for reconditioning a work surface of an optical disc. The buffing head includes a rotary element for rotating the disc. A buffing element is configured to contact the work surface so that rotation of the disc enables corresponding movement of the buffing element. A well surrounds the buffing element and contains a fluid. Movement of the buffing element causes the buffing element to be immersed into the fluid and to be returned into contact with the work surface.

The above and other advantages of the present invention are carried out in yet another form by in a method of reconditioning a work surface of an optical disc utilizing a buffing head that includes a rotary element and a buffing element configured for restricted rotation relative to the rotary element. The method calls for retaining the optical disc on the rotary element with the work surface in contact with the buffing element, and rotating the optical disc at a first speed via the rotary element, rotation of the optical disc enabling corresponding movement of the buffing element. The method further calls for restricting movement of the buffing element to a second speed to recondition the work surface, the second speed being slower than the first speed.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
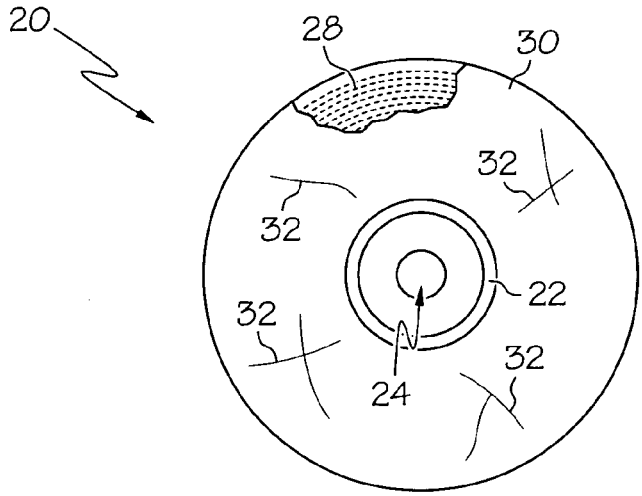
FIG. 1 shows a diagram of an optical disc.

FIG. 1 shows a diagram of an optical disc 20. Optical disc 20 may be a compact disc, digital versatile disc (DVDs), CD-ROM, recordable CD (CD-R), re-writable CD (CD-RW), a game disc, and the like. Optical disc 20 generally includes a center section, or clamping area 22, located about a center hole 24 of disc 20. Surrounding clamping area 22 is a narrow text band 26 typically used to identify the manufacturer. Clamping area 22 and text band 26 do not contain encoded data. A data layer 28 lies outside of text band 26. Data layer 28 is arranged in spiral tracks and is covered by a protective surface 30. Disc 20 is shown with a portion of protective surface 30 removed to show the underlying spiral arranged data layer 28. In addition, disc 20 is shown with surface imperfections, such as, scratches 32, in protective surface 30 that render disc 20 unplayable or visually unappealing.

In general, when disc 20 is undamaged, the laser beam of the disc playback equipment enters disc 20 on the play side, travels through protective surface 30, picks up information from data layer 28, and bounces off a reflective coating on the back side of data layer 28. The reflected laser beam then travels back through protective surface 30, out of disc 20, and into a "detector". The detector then helps the playback equipment convert the information carried by the laser into sound, video, and/or data.

When disc 20 is a music compact disc (CD), the first band of data layer 28 closest to text band 26, called the "lead-in", contains the table of contents for the CD. The lead-in tells the CD playback equipment how to navigate around disc 20. Scratches 32 or other damage-in this area can render disc 20 completely unplayable. In a music CD, the song tracks of data layer 28 begin just outside the lead-in. Scratches 32 in protective layer 30 of disc 20 in an area of data outside the lead-in usually affect only the music that is contained in that area. However, with more severe damage the CD playback equipment can sometimes "lock up" on the damaged area so that the laser cannot detect later song tracks.

The present invention reconditions a work surface, i.e., protective surface 30, of disc 20 to remove scratches 32 or other surface imperfections that might otherwise render disc 20 unplayable or visually unappealing. In addition, it will become clear in the following description that the present invention is readily expandable between consumer and commercial/industrial applications.

Figure 2:
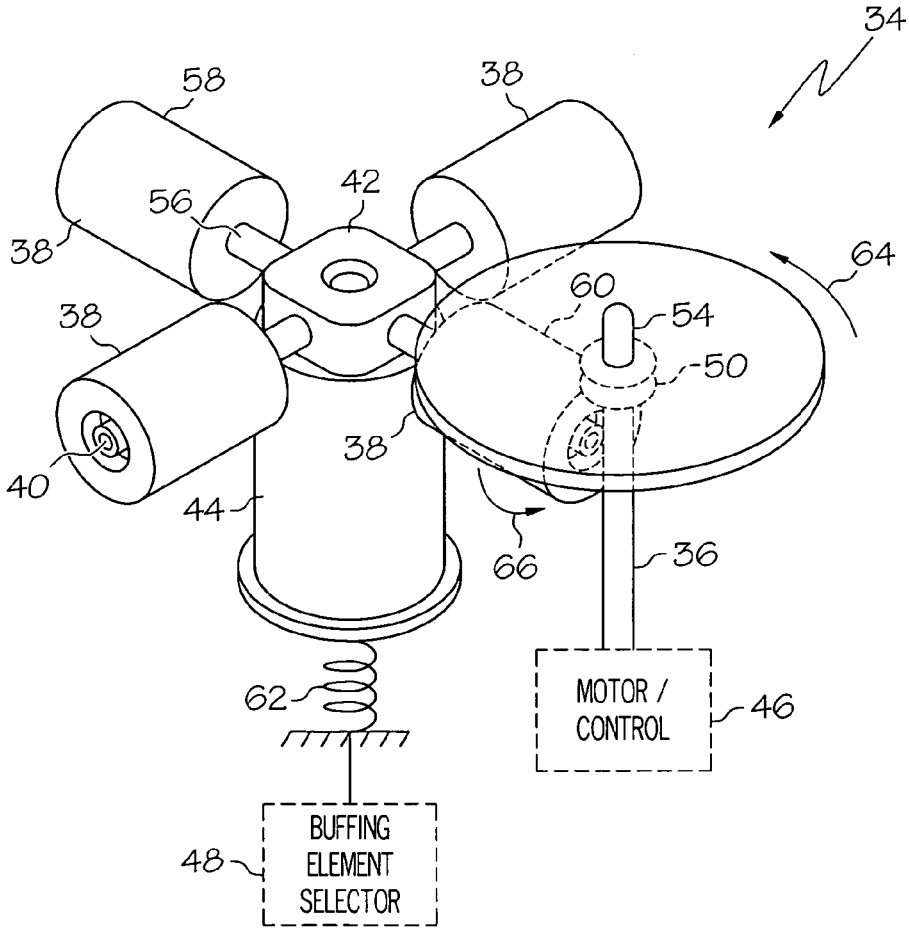
FIG. 2 shows a perspective view of a buffing head in accordance with an exemplary embodiment of the present invention.

FIG. 2 shows a perspective view of a buffing head 34 in accordance with an exemplary embodiment of the present invention. Buffing head 34 includes a rotary element 36 for retaining optical disc 20, a buffing element 38 configured to contact protective surface 30 of optical disc 20, and a restrictor 40 in communication with buffing element 38.

Generally, rotary element 36 rotates optical disc 20 at a first speed. As disc 20 rotates, the contact between optical disc 20 and buffing element 38 enables corresponding movement of buffing element 38. However, restrictor 40 restricts movement of buffing element 38 such that buffing element 38 moves at a second speed to recondition protective surface 30, the second speed being slower than the first speed. Thus, buffing element 38 is a non-driven, moveable grinding surface, whose movement is restricted via restrictor 40. Refraining from driving both optical disc 20 and buffing element 38 saves costs related to motor and/or transmission that otherwise would be needed to drive the non-driven buffing element 38.

In this exemplary embodiment, buffing head 34 includes a number of buffing elements 38 coupled to a working end 42 of a shaft 44. The multiple buffing elements 38 enable a multi-stage reconditioning operation by sequential rotation of each of buffing elements 34 into contact with protective surface 30. A motor/control block 46 may be used to control rotational speed of rotary element 36, and a buffing element selector block 48 (both shown in ghost form) may be used to control rotation of shaft 44 thereby moving one each of buffing elements 38 into contact with protective surface 30.

Rotary element 26 includes a stop 50 upon which a center section, i.e. clamping area 22 (FIG. 1), of optical disc 20 is held. Buffing head 34 may further include a retaining bolt 52 (see FIG. 9) or another similar mechanism for holding optical disc 20 in fixed relation with stop 50. In a preferred embodiment, a spindle portion 54 of rotary element 36 is directed through center hole 24 of optical disc 20, and disc 20 is seated upon stop 50 with protective surface 30 facing downward. As such, rotary element 36 is configured for location largely below disc 20 for simplicity of design, ease of ingress and egress of disc 20, and so that debris from the buffing process will fall away from protective surface 30. However, those skilled in the art will recognize that other rotary element configurations may retain disc 20 from above, as opposed to below, disc 20.

Buffing head 34 includes four buffing elements 38, each having successively finer grit abrasive material, to enable a four stage reconditioning process. However, it should be understood that shaft 44 may include more or less buffing elements 38 in response to desired reconditioning parameters. In addition, buffing head 34 is readily expandable to simultaneously recondition multiple discs. By way of example, buffing head 34 may be surrounded by up to four rotary elements for retaining and concurrently rotating up to four discs 20. Thus, all four discs 20 could be reconditioned simultaneously, either with the same abrasive used on each of buffing elements 38 or with each being reconditioned at a different buffing stage.

In a preferred embodiment, each of buffing elements 38 includes an axle 56 and a roller 58 mounted on axle 56. Thus, roller 58 is allowed to move about axle 56 to recondition protective surface 30. However, no movement is required in a third dimension to raise and lower buffing element 38 into contact with optical disc 20. This leads to a less complex and less costly mechanism than prior art devices.

Roller 58 may be formed from an abrasive material to achieve a desired degree of buffing, or a soft polishing material to achieve finish polishing. By way of example, roller 58 may be formed from a foam impregnated with abrasive grit. Alternatively, open cell foam may be used with a grinding powder. In yet another configuration, roller 58 may be formed from paper grit wrapped around axle 56 several layers thick. The user could then simply tear off and discard the outer layer when it wears out.

Axle 56 is oriented approximately parallel to the plane of protective surface 30 of disc 20. In addition, axle 56 and roller 58 extend substantially along a radius of disc 20. This contact geometry between buffing element 38 and disc 20 accomplishes "line-on-flat reconditioning". The term "line-on-flat reconditioning" refers to a one-dimensional line 60 against a plane, i.e., protective surface 30, at which buffing is taking place. Line-on-flat reconditioning is desirable because it is simpler and less costly to implement than prior art devices in which two planes (a buffing surface and the protective surface) must be kept precisely parallel. Moreover, this contact geometry prevents "tree-ring" or other visible ring-like patterns from forming on the reconditioned protective surface 30.

Although, the axle and roller configuration of buffing element 38 is preferred, nothing requires the use of the axle and roller configuration. For example, in an alternative embodiment, buffing element 38 may be a tape or ribbon mechanism, arranged with feed and take-up reels, that has a buffing surface configured for contact with optical disc 20. Buffing head 34 may optionally include a spring system 62 pushing up on shaft 44 and consequently buffing elements 38 to maintain a constant pressure between buffing elements 38 and protective surface 30 despite dimensional variations between the buffing elements, and as the buffing elements are used up.

As mentioned above, when disc 20 rotates (represented by a first arrow 64), roller 58 correspondingly rotates (represented by a second arrow 66) due to the contact between protective surface 30 and buffing element 38. If the speed of roller 58 is left unrestricted, roller 58 will soon be rotating as rapidly as optical disc 20, leading to highly ineffective buffing of protective surface 30. In the exemplary embodiment, restrictor 40 may be a bolt that is tightened against roller 58 to provide pressure against roller 58, thus restricting rotational speed of roller 58. This ability to control the speed of rotation of each roller 58 is important to fast and effective buffing.

Restrictor 40 may be adjusted, for example, by further tightening or loosening the bolt. Thus, the rotational speed of each of buffing elements 38 can be individually adjusted in response to the type and wear of the abrasive, the hardness of the particular material used to manufacture protective surface 30, and so forth. As such, a second one of restrictors 40 in communication with a second one of buffing elements 38 may restrict rotation of its corresponding roller 58 to a third speed that is also slower than the speed of disc 20.

It should be understood for the purposes of the present invention, that restrictor 40 may also be adjusted to restrict all movement of buffing element 38. Such a scenario may be envisioned for some physical configurations of buffing element 38 and/or depending upon the buffing material used to form buffing element 38.

Although a bolt is discussed herein for restricting the rotational speed buffing element 38, nothing requires the use of a bolt. In an alternative embodiment a spring may be employed that is tightened to a predetermined torque against roller 58. Alternatively, restrictor 40 may be integral to the buffing element design. For example, axle 56 may be molded to have a bow. When the axle 56 is inserted into roller 58, the bow causes friction thereby forming a brake using only axle 56 and roller 58. Different rollers may have different amounts of bow in their associated axle and thereby have different amounts of braking.

The exemplary configuration of buffing head 34 may be employed in a simple and affordable reconditioning device for the consumer market, in which a relatively low volume of discs will be reconditioned. Buffing elements 38 may be configured with progressively finer amounts of abrasive to accomplish multi-stage buffing. As such, in operation, optical disc 20 is retained on rotary element 36 with the work surface, i.e., protective surface 30, of disc facing in a downward position. Buffing elements 38 may be adjusted via buffing element selector 48 so that the coarsest buffing element 38 is first in contact with protective surface 30. Selector 48 may be a manually actuated device for affordable consumer models, or may be an automatic device actuated in response to time, surface smoothness, and the like.

Motor/control block 46 may then activated to rotate rotary element 36 at a first speed, for example, 3000 RPM. Rotation of disc 20 causes corresponding movement of buffing element 38, restricted to a second speed, to recondition protective surface 30. Following reconditioning by a first one of buffing elements 38, buffing elements 38 are adjusted via buffing element selector 48 so that a finer buffing element 38 is selected, and the next stage of reconditioning commences. The operations described above are repeated for each reconditioning stage.

Nothing requires that buffing element 38 first be moved into contact with disc 20 prior to activation of motor/control block 46. In an alternative embodiment, motor/control block 46 may be activated to rotate rotary element 36 at the first speed. Subsequently, buffing elements 38 may be adjusted via buffing element selector 48 to move one of buffing elements into contact with disc 20. In addition, nothing requires that the first speed of rotary element 36 be a constant speed. Rather the first speed of rotary element may optionally be a variable speed. Due to the contact between disc 20 and buffing element 38, the second speed of buffing element 38 may also be variable.

Figure 3:
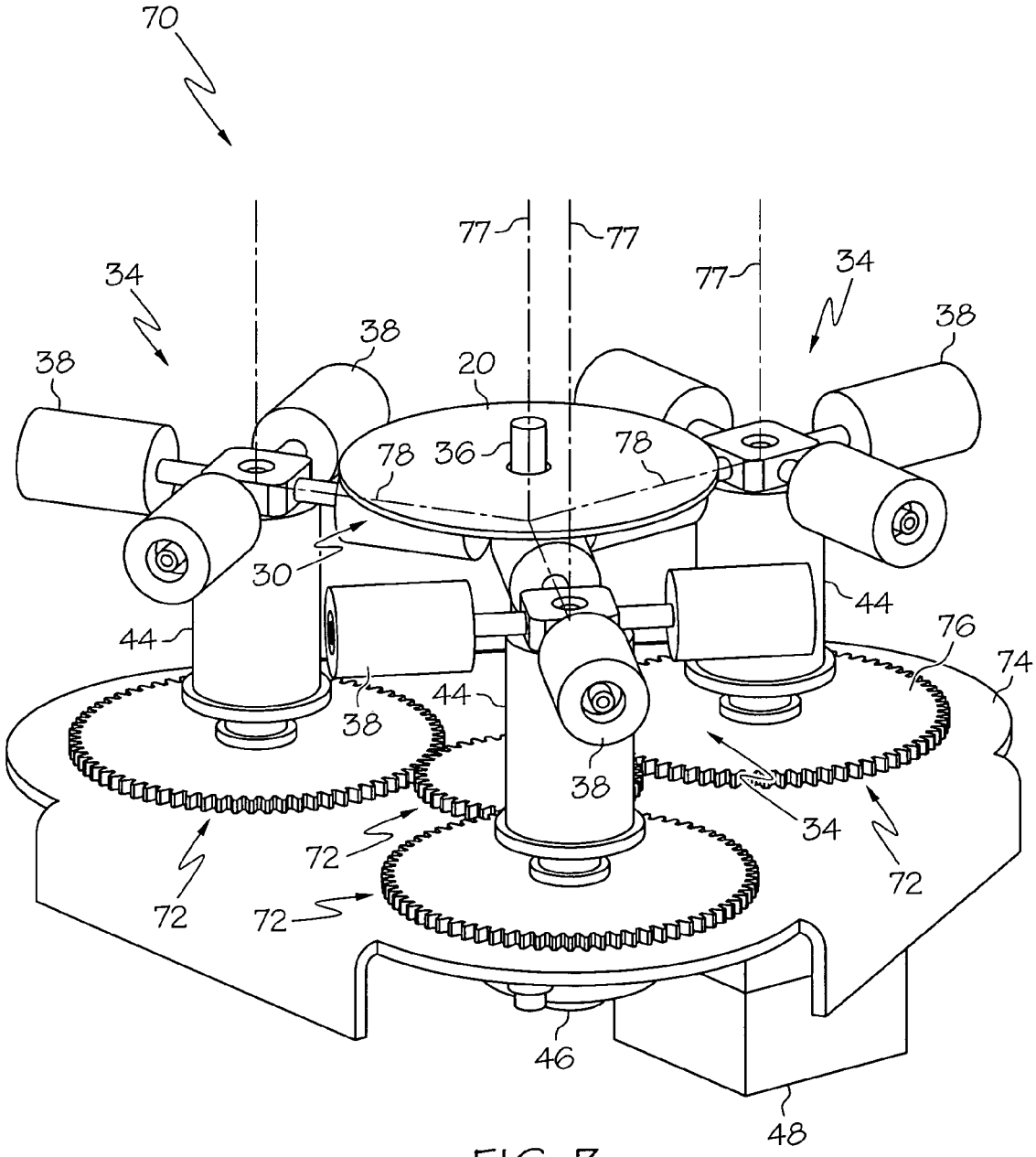
FIG. 3 shows a perspective view of another exemplary buffing head.

FIG. 3 shows a perspective view of another exemplary buffing head 70. Buffing head 34 (FIG. 2) forms a basic unit, or building block, which is expandable for higher end consumer applications and commercial/industrial applications. As shown, buffing head 70 includes three of buffing heads 34 surrounding rotary element 36. A gear system 72, in the form of toothed wheels, is mounted on a platform 74. Gear system 72 interlocks each shaft 44 of each buffing head 34. Thus, when buffing element selector 48 is actuated to rotate a first toothed wheel 76 of gear system 72, the remaining toothed wheels rotate to move the selected one of buffing elements 38 from each shaft 44 into contact with protective surface 30 of optical disc 20.

Gear system 72 is representative of just one system for rotating shafts 44 to rotate buffing elements 38 into contact with protective surface 30. Those skilled in the art will readily recognize that different mechanisms may be envisioned for rotating buffing elements 38 into contact with protective surface 20. Furthermore, nothing requires that shafts 44 rotate cooperatively to concurrently move multiple buffing elements 38 into contact with protective surface 30. Rather, in an alternative embodiment, each of buffing heads 34 may be driven independently.

Buffing head 70 is arranged so that three buffing elements 38 are simultaneously in contact with protective surface 30. In particular, shafts 44 of each of buffing heads 34 are axially aligned with, and offset from rotary element 36, as represented by lines 77. In addition, each of the three buffing elements 38 has the same degree of abrasiveness. As such, the three buffing elements 38 immediately surrounding rotary element 38 can concurrently recondition protective surface 30 during one stage of a reconditioning operation. Furthermore, each successive buffing element 38 can have progressively finer abrasive material, as discussed above. Accordingly, a multi-stage reconditioning process can occur concurrently along three lines 78 when motor/control block 46 is activated to rotate rotary element 36 and disc 20. Thus, buffing head 70 may be advantageously utilized to provide more than one point of contact for the line-on-flat reconditioning described above. The concurrent use of multiple buffing elements, each having the same grit of abrasiveness, can more rapidly recondition disc 20.

It should be apparent that by using the basic buffing head 34, multiple configurations of buffing heads may be envisioned. For example, a reconditioning process that calls for more than four buffing stages could necessitate separate selection and rotation of each shaft 44 for contact by only one or two of buffing elements 38 to protective surface 30 at a given reconditioning stage.

Figure 4:
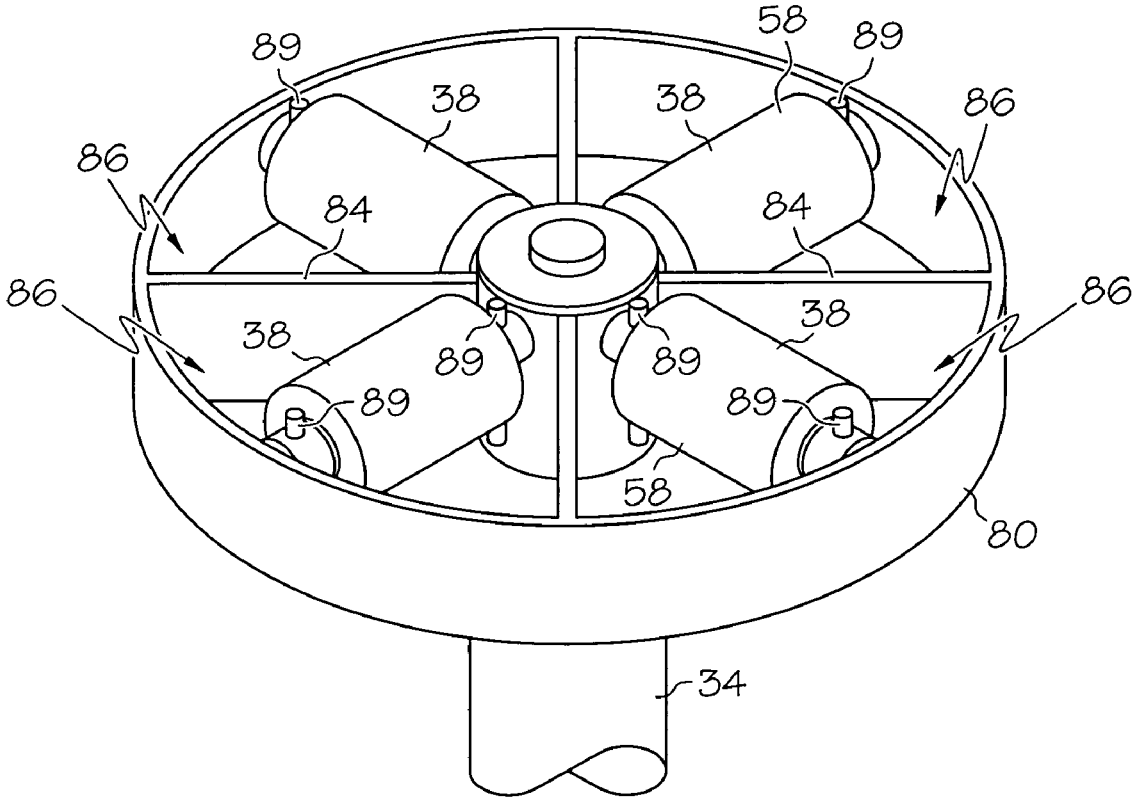
FIG. 4 shows a perspective view of a well that may be used with the exemplary buffing heads of FIGS. 2–3.
Figure 5:
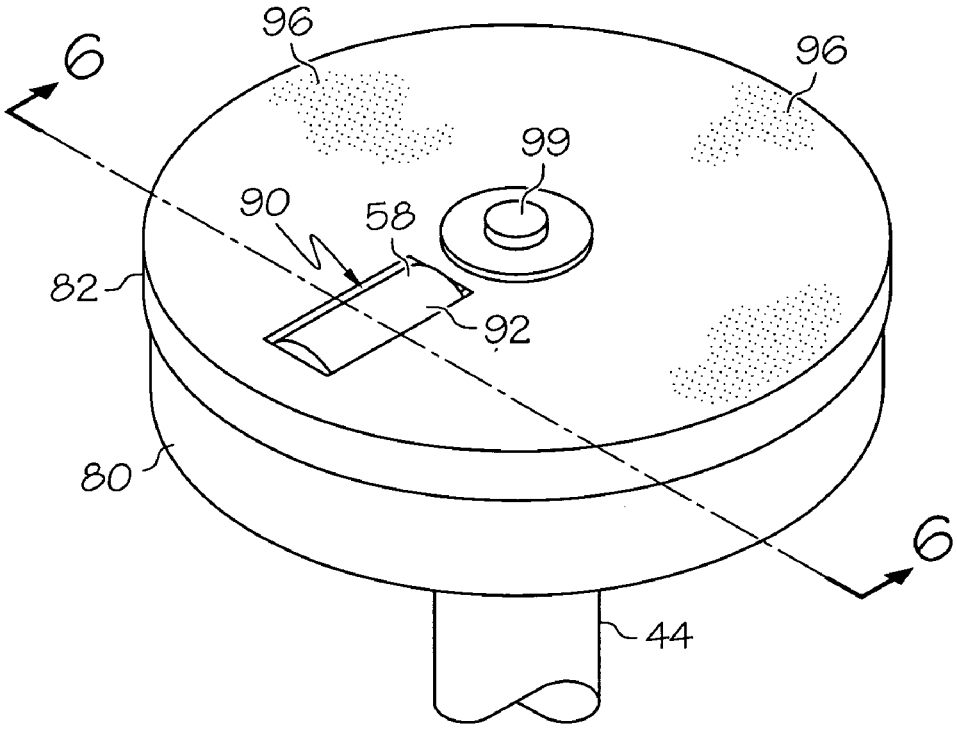
FIG. 5 shows a perspective view of a cover coupled to the well of FIG. 4.
Figure 6:
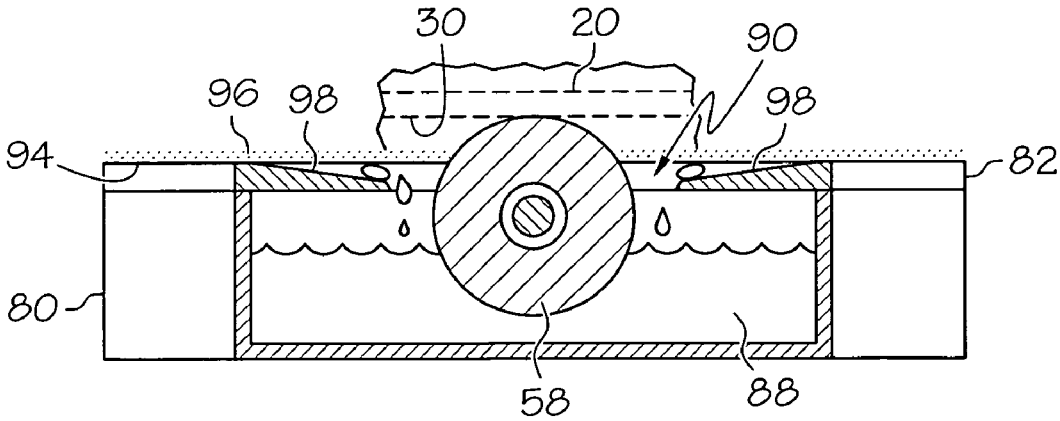
FIG. 6 shows a side sectional view of the cover and well along section lines 6—6 of FIG. 5.

Referring to FIGS. 4–6, FIG. 4 shows a perspective view of a well system 80 that may be used with exemplary buffing heads 34 and 70 of FIGS. 2–3. FIG. 5 shows a perspective view of a cover 82 engaged with well system 80, and FIG. 6 shows a side sectional view of cover 82 and well system 80 along section lines 6—6 of FIG. 5. Although air may be blown over buffing elements 38 of the configurations shown in FIGS. 2 and 3, to remove buffing debris, it may be desirable to utilize a fluid to both cool protective surface 30 and to more effectively remove buffing debris from protective surface 30 during reconditioning. Alternatively, it may be desirable to utilize a fluid abrasive or polishing material to more effectively recondition disc 20.

As shown, well system 80 includes partitions 84 used to form separate wells 86, each surrounding a separate one of buffing elements 38 of buffing head 34. Each of wells 86 can contain a fluid 88, such as water, in which each buffing element 38 is partially immersed. When roller 58 rotates in response to the rotation of disc 20 (shown in ghost form in FIG. 6), a portion of roller 58 becomes immersed into fluid 88. Buffing debris from that immersed portion of roller 58 is rinsed off in fluid 88, and roller 58 cools in fluid 88. Having now picked up fluid 88, continued rotation of roller 58 causes that portion of roller 58 to return into contact with protective surface 30. Fluid 88, absorbed into roller 58, cools protective surface 30 and rinses buffing debris away from protective surface 30.

It should be noted in the embodiment of FIG. 4 that axles 56 of buffing elements 38 extend from an interior of rollers 58. In addition, vertically oriented pins 89 extend approximately perpendicular to axles 56. Pins 89 may be employed to hold rollers 58 in place in their respective wells 86. Optionally, pins 89 may be configured with spring systems (not shown) that push buffing element 38 upwardly so that the line of contact between buffing element 38 and protective surface 30 floats relative to disc 20. Such a mechanism serves to maintain proper pressure and alignment between buffing element 38 and protective surface 30 in spite of manufacturing tolerances and buffing surface wear.

Separate wells 86 are preferred when each of buffing elements 38 is configured with a different abrasive material so that debris in fluid 88 from a coarse reconditioning stage does not contaminate fluid 88 for a finer reconditioning stage. However, waste grit from the same stage and returned to protective surface does not pose a problem, and may even enhance reconditioning capability of buffing element 38. In addition, separate wells 86 advantageously enables the use of fluid 88 in some wells 86, while enabling another well 86 or wells 86 to be empty. Such a situation may be desired if a buffing stage, for example, the final buffing stage, is to be a dry buffing stage.

Nothing requires that each of wells 86 have the same fluid. Rather, different wells 86 may contain different fluids. Moreover, although the fluid contained in wells 86 is described above as being water, it should be understood, that the fluid contained in wells 86 may alternatively be a liquid-based or a powder-form buffing compound. These buffing compounds can be picked up on roller 58, and can be carried by roller 58 to protective surface 30, as roller 58 is immersed in the buffing compound. Such a scenario may permit the use of less buffing compound because of reuse of the buffing compound as roller 58 rotates into and out of well 86.

Nor is it required that well system 80 include multiple wells 86. In another exemplary embodiment, when some or all of buffing elements 38 of buffing head 34 are configured with the same abrasive material, partitions 84 need not be utilized. As such, each of buffing elements 38 can share a common body of fluid 88.

Cover 82 encloses well system 80, but has an opening 90 through which a portion 92 of roller 58 of one of buffing elements 38 extends. In the exemplary embodiment shown in FIGS. 5–6, one of buffing elements 38 may be selectively exposed through opening 90. That is, shaft 44 (FIG. 2) may be rotated a pre-determined distance (for example, ninety, one hundred and eighty, or two hundred and seventy degrees) as discussed above so that the selected roller 58 extends through opening 90 to contact protective surface 30. Cover 82 prevents protective surface 30 from coming into inadvertent contact with another (for example, a coarser) one of buffing elements 38.

If disc is bent by the retaining mechanism holding disc 20 onto rotary element 36 (FIG. 2), or if disc 20 is slightly warped, protective surface 30 may come into contact with an outer surface 94 of cover 82. This contact may cause inadvertent scratching of protective surface by cover 82. Accordingly, outer surface 94 of cover 82 may optionally include a cushion material 96. Cushion material 96 largely prevents protective surface 30 from coming into contact with the harder outer surface 94 of cover 82 during reconditioning so that protective surface 30 is not inadvertently scratched by outer surface 94 of cover 82. In an exemplary embodiment, cushion material 96 may be formed from the same material utilized with buffing elements 38 to perform the final reconditioning stage.

As roller 58 absorbs fluid 88 and is returned into contact with protective surface 30, some of fluid 88 will escape from well 86 through opening 90. It is desirable that this escaped fluid 88 be returned into well 86. To that end, cover 82 further includes a guide 98 for directing an escaped amount of fluid 88 back into one of wells 86. In an exemplary embodiment, guide 98 is a sloped portion of cover 82 surrounding opening 90. The slope of guide 98 enables escaped fluid 88 to flow back into well 86 thereby resulting in less waste of fluid 88 and a cleaner reconditioning environment. Although a sloped guide portion of cover 82 is described herein for directing escaped fluid 88 back into well 86, those skilled in the art will recognize that guide 98 can take on other forms that effectively direct fluid 88 back into its well 86.

Although well system 80 is shown as providing a holding zone for fluid 88, in some commercial/industrial applications, it may be desirable to externally feed fluid 88 to and remove fluid 88 from well system 80. In such a scenario, supply and drain lines (not shown) may breach well system 80 to provide a fluid exchange mechanism. Alternatively, supply lines may be directed through each of buffing elements 38 so as to feed fluid from an interior of roller 58 to an exterior surface of roller 58. In addition, roller 58 may optionally include spiral grooves so as to channel more of fluid 88 to the outer perimeter region of optical disc 20 where greater relative speed occurs. Such a configuration serves to promote greater cooling in the outer perimeter region of disc 20 where there may be greater heat build-up.

FIGS. 5–6 show cover 82 engaged with well system 80 when fluid 88 is desired in connection with the reconditioning process. In an alternative embodiment, a buffing head need not include well system 80, but may still include cover 82. In such a scenario, cover 82 is stationary, but shaft 44 is allowed to rotate. Thus, cover 82 conceals buffing elements 38. However, as shaft 44 rotates, one of rollers 58 of buffing elements 38 is selectively exposed via opening 90 so that a dry reconditioning process may commence.

Figure 7:
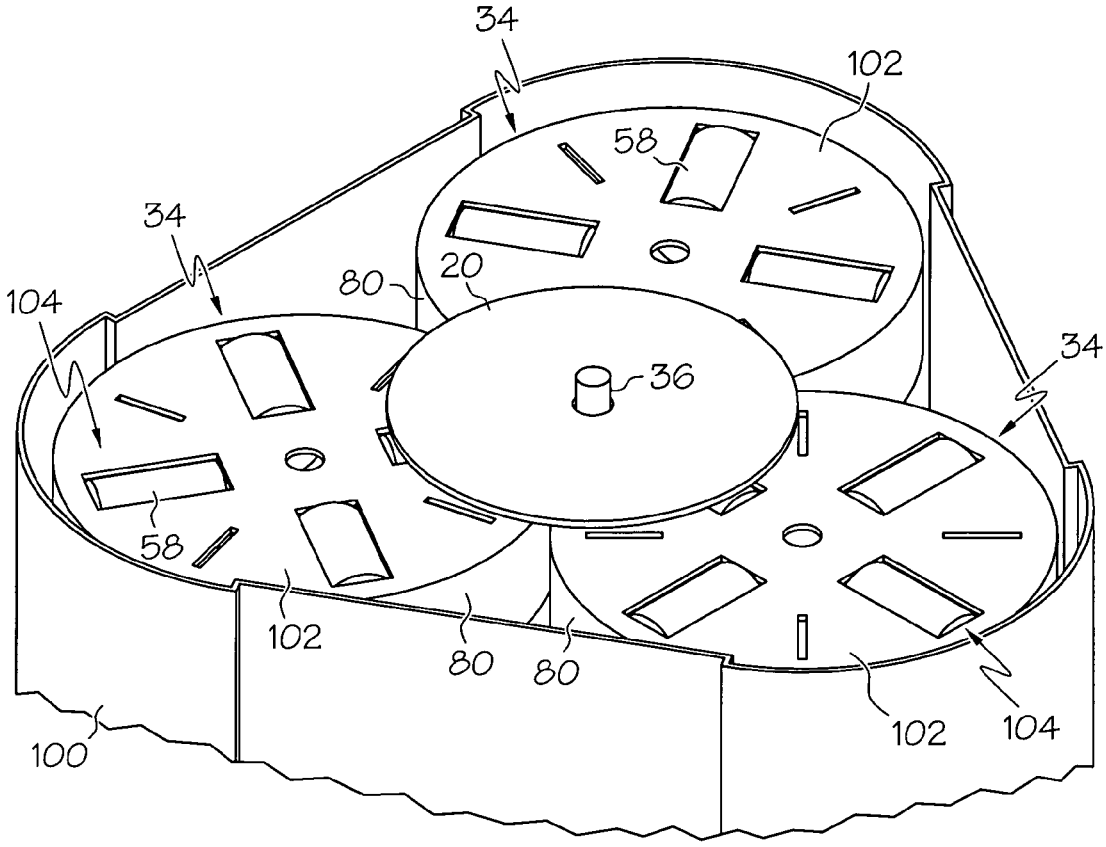
FIG. 7 shows a perspective view of the buffing head of FIG. 3 retaining the optical disc of FIG. 1.

FIG. 7 shows a perspective view of buffing head 70 retaining optical disc 20. As shown, three buffing heads 34 are enclosed in a housing 100, and buffing elements 38 of each of buffing heads 34 are surrounded by well systems 80 discussed in detail above. In accordance with an alternative embodiment, a cover 102, having multiple openings 104, is engaged with each of well systems 80. Each roller 58 of each of buffing elements 38 extends through its corresponding opening 104.

As mentioned previously, buffing head 70 may be utilized in commercial/industrial applications in which high throughput and effective reconditioning are required. Multiple rollers 58 are exposed at any given instant through openings 104. Thus, buffing head 70 may be readily expanded by adding one or more rotary elements between one or more buffing heads 34. Consequently, the multiple exposed buffing elements 38 may be utilized to simultaneously recondition multiple optical discs 20.

Figure 8:
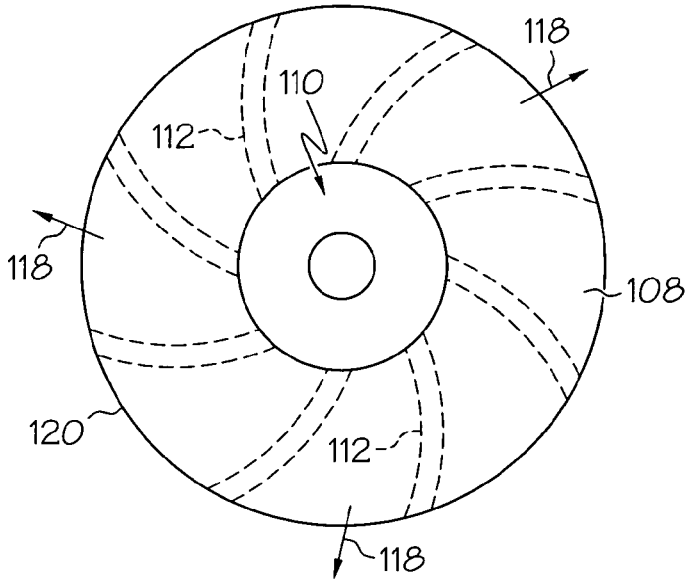
FIG. 8 shows a top view of a platen for retaining the optical disc in fixed relation with a rotary element of the exemplary buffing heads of FIGS. 2–3.
Figure 9:
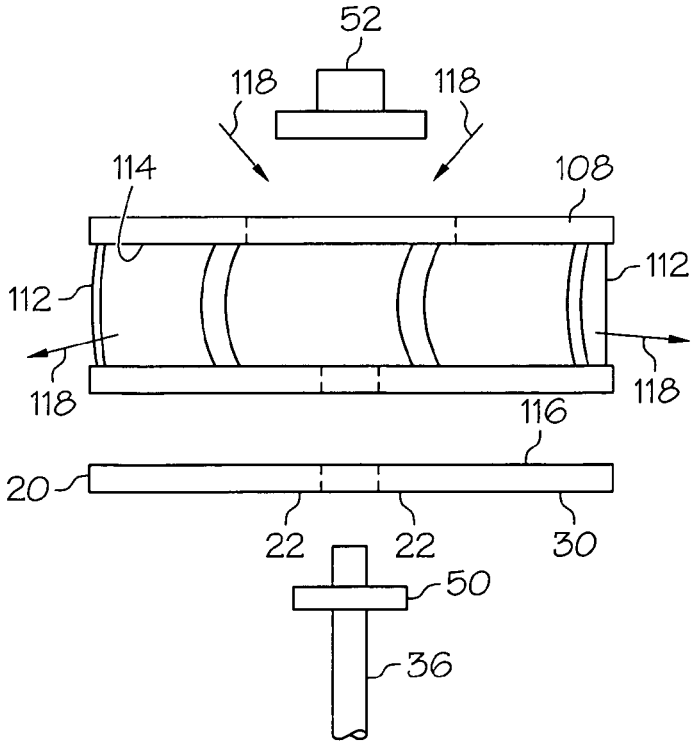
FIG. 9 shows an exploded side view of the platen of FIG. 9 with a retaining bolt, the optical disc, and the rotary element of the exemplary buffing heads of FIGS. 2–3 and 7.

Referring to FIGS. 8–9, FIG. 8 shows a top view of a platen 106 for retaining optical disc 20 in fixed relation with rotary element 36 of exemplary buffing heads 34 and 70 of FIGS. 2–3 and 7. FIG. 9 shows an exploded side view of platen 106 with retaining bolt 52, disc 20, and rotary element 36.

Platen 106 serves to apply a predetermined amount of pressure across optical disc 20. Platen 106 includes a platen surface 108 having a central opening 110, and radially extending ribs 112 projecting from a disc facing side 114 of platen surface 108. Ribs 112 are configured to contact a non-working surface 116, i.e., the label side, of optical disc 20 opposite from protective surface 30.

In operation, optical disc 20 is placed with protective surface 30 facing downward onto rotary element 36 so that clamping area 22 of optical disc 20 is held upon stop 50. Platen 106 is then placed on optical disc 20, with ribs 112 abutting optical disc 20. Retaining bolt 52 couples to rotary element 36 to retain optical disc 20 onto rotary element 50.

In such a configuration, when optical disc 20 is driven by rotary element 36 to rotate at a high rate of speed (e.g., 3000 RPM), air, represented by arrows 118, is drawn in through central opening 110 and exits at a circumference 120 of platen 106. Accordingly, platen 106 functions as a squirrel-cage blower to move air 118 across non-working surface 116 of optical disc 20. The air movement helps to cool disc 20, thereby permitting faster operation. In addition, the exhausted air 118 can be ported over adjacent unused buffing elements, thereby keeping them free of waste debris. Ribs 112 also aid in the separation of optical disc 20 from platen 106.

In summary, the present invention teaches of buffing heads and a reconditioning method that can restore both the playback quality and the visual appearance of an optical disc. More specifically, the present invention teaches of a buffing head having non-driven, rotatable buffing elements, the buffing elements rotating in response to rotation of the optical disc. The non-driven, rotatable buffing elements are equipped with a restrictor so that they move at a controlled speed that is slower than the optical disc. The line-on-flat contact geometry between buffing elements and the protective surface of the optical disc and the controlled speed of the buffing elements yields effective scratch removal. The present invention further teaches of a well system for facilitating the use, and mitigating the waste, of cooling liquid. In addition, the present invention teaches of a buffing head that is readily expandable between cost effective consumer applications and high throughput commercial/industrial applications by including multiple buffing elements on a common and/or on separate shafts.

Although the preferred embodiments of the invention have been illustrated and described in detail, it will be readily apparent to those skilled in the art that various modifications may be made therein without departing from the spirit of the invention or from the scope of the appended claims. For example, a single shaft of a single buffing head may include multiple buffing elements of the same degree of abrasiveness. By way of another example, a buffing head may be expandable in a number of configurations to concurrently recondition multiple optical discs.

What is claimed is:

1. A buffing head for reconditioning a work surface of an optical disc comprising:

a rotary element for rotating said optical disc;

a buffing element configured to contact said work surface so that rotation of said disc enables corresponding movement of said buffing element; and a well surrounding said buffing element, said well containing a fluid, and movement of said buffing element causes said buffing element to be immersed into said fluid and to be returned into contact with said work surface.

2. A buffing head as claimed in claim 1 wherein said buffing element comprises:

an axle; and a roller mounted on said axle, said roller rotating about said axle in response to said rotation of said optical disc.

3. A buffing head as claimed in claim 1 further comprising a cover engaged with said well, said cover having an opening, and a portion of said buffing element extending through said opening.

4. A buffing head as claimed in claim 3 wherein an outer surface of said cover includes a cushion material.

5. A buffing head as claimed in claim 3 wherein said cover includes a guide for directing an escaped amount of said fluid back into said well.

6. A buffing head as claimed in claim 3 wherein said buffing element is selectively exposable through said opening.

7. A buffing head as claimed in claim 1 wherein said buffing element is a first buffing element and said buffing head further comprises a second buffing element surrounded by said well and configured to contact said work surface so that rotation of said disc enables corresponding movement of said second buffing element, and movement of said second buffing element causes said second buffing element to be immersed into said fluid and to be returned into contact with said work surface.

8. A buffing head as claimed in claim 1 wherein said buffing element is a first buffing element, said well is a first well, and said buffing head further comprises:

a second buffing element configured to contact said work surface so that rotation of said disc enables corresponding movement of said second buffing element; and a second well surrounding said second buffing element, said second well containing a second fluid in communication with said second buffing element, and movement of said second buffing element causes said second buffing element to be immersed into said second fluid and to be returned into contact with said work surface.

9. A method of reconditioning a work surface of an optical disc utilizing a buffing head that includes a rotary element, a buffing element, and a well containing a fluid, said method comprising:

retaining said optical disc on said rotary element in contact with said buffing element;

rotating said optical disc in response to said rotary element;

immersing said buffing element into said fluid; and returning said buffing element into contact with said work surface, said immersing and returning operations occurring in response to movement of said buffing element.

10. A method as claimed in claim 9 wherein:

said buffing element is a first buffing element and said well containing said fluid is a first well containing a first fluid;

said buffing head includes a second buffing element and a second well containing a second fluid; and said method further comprises positioning one of said first and second buffing elements into contact with said work surface.

11. A buffing head for reconditioning a work surface of an optical disc comprising:

a rotary element having a spindle configured to receive a center section of said optical disc, said rotary element enabling rotation of said disc at a first speed;

a first shaft axially aligned with and offset from said rotary element;

a first buffing element coupled to and extending radially from said first shaft, said first buffing element being configured to selectively contact said work surface so that rotation of said disc enables corresponding movement of said first buffing element;

a second shaft axially aligned with and offset from said rotary element; and a second buffing element coupled to and extending radially from said second shaft, said second buffing element being configured to selectively contact said work surface so that rotation of said disc enables corresponding movement of said second buffing element.

12. A buffing head as claimed in claim 11 wherein both of said first and second buffing elements are configured for concurrent contact with said work surface.

13. A buffing head as claimed in claim 11 wherein said buffing head further includes a third buffing element coupled to and extending radially from said first shaft, said first shaft selectively rotating to position one of said first and third buffing elements in contact with said work surface so that rotation of said disc enables corresponding movement of said one of said first and third buffing elements.

14. A buffing head as claimed in claim 11 further comprising a restrictor in communication with said first buffing element for restricting movement of said first buffing element such that said first buffing element moves at a second speed to recondition said work surface, said second speed being slower than said first speed.

15. A buffing head as claimed in claim 11 further comprising a well surrounding said first buffing element, said well containing a fluid in communication with said first buffing element.

* * * * *